US008075336B2

(12) United States Patent
Koellman

(10) Patent No.: US 8,075,336 B2
(45) Date of Patent: Dec. 13, 2011

(54) BRIDGE ELEMENT AND SET COMPRISING A CLAMPING ELEMENT AND A BRIDGE ELEMENT

(75) Inventor: Hans-Josef Koellman, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 8 days.

(21) Appl. No.: 12/822,448

(22) Filed: Jun. 24, 2010

(65) Prior Publication Data

US 2011/0151711 A1 Jun. 23, 2011

(30) Foreign Application Priority Data

Jun. 25, 2009 (DE) ..... 10 2009 030 645

(51) Int. Cl.
*H01R 31/08* (2006.01)

(52) U.S. Cl. ..... 439/511

(58) Field of Classification Search ..... 439/507–513, 439/752, 595, 638

See application file for complete search history.

(56) References Cited

U.S. PATENT DOCUMENTS

| | | | | |
|---|---|---|---|---|
| 7,118,423 | B2 * | 10/2006 | Kobayashi et al. | 439/682 |
| 7,182,631 | B2 * | 2/2007 | Kollmann | 439/511 |
| 7,942,692 | B2 * | 5/2011 | Bodenmeier | 439/511 |
| 2004/0106322 | A1 * | 6/2004 | Forsberg | 439/511 |
| 2005/0095905 | A1 * | 5/2005 | Diekmann | 439/511 |
| 2006/0110975 | A1 * | 5/2006 | Barrat et al. | 439/511 |

FOREIGN PATENT DOCUMENTS

| | | |
|---|---|---|
| DE | 33 12 002 | 4/1983 |
| DE | 36 25 240 | 7/1986 |
| DE | 42 23 540 | 7/1992 |
| DE | 43 22 535 | 7/1993 |
| DE | 44 11 306 | 3/1994 |
| DE | 94 06 612 | 4/1994 |
| DE | 195 06 859 | 2/1995 |
| DE | 295 14 014 | 9/1995 |
| DE | 296 05 280 | 3/1996 |
| DE | 102 12 511 | 3/2002 |
| DE | 197 08 649 | 1/2006 |

* cited by examiner

*Primary Examiner* — Jean Duverne
(74) *Attorney, Agent, or Firm* — Whitham Curtis Christofferson & Cook, PC

(57) ABSTRACT

A bridge element (5) having at least two bridge prongs (4), which are intended to be inserted into the respective bridge shafts (2) and to make electrically conductive contact with a contact point (3), which is arranged in the bridge shaft (2), of one or more clamping elements (1A-1G), and having a bridge section (10) which is electrically conductively connected to the bridge prongs (4) is described. The bridge prongs (4) and the bridge section (10) are electrically conductive and extend parallel to one another in a common insertion direction (Z). At least the external b ridge prongs (4) each have a profile which is of L-shaped cross section and has an outer contact section (9) which extends flat in the direction (Z) of extent and in the bridging direction (Y) which faces the adjacent bridge prongs (4), and an inner contact section (6) which starts from the outer contact section (9) transverse to the bridging direction (Y). The inner contact sections (6) of the two external bridge prongs (4) are at a smaller distance from one another than the distance between the free ends of the outer contact sections (9) of the two external bridge prongs (4).

11 Claims, 4 Drawing Sheets

BRIDGE ELEMENT AND SET COMPRISING A CLAMPING ELEMENT AND A BRIDGE ELEMENT

Figure 1:
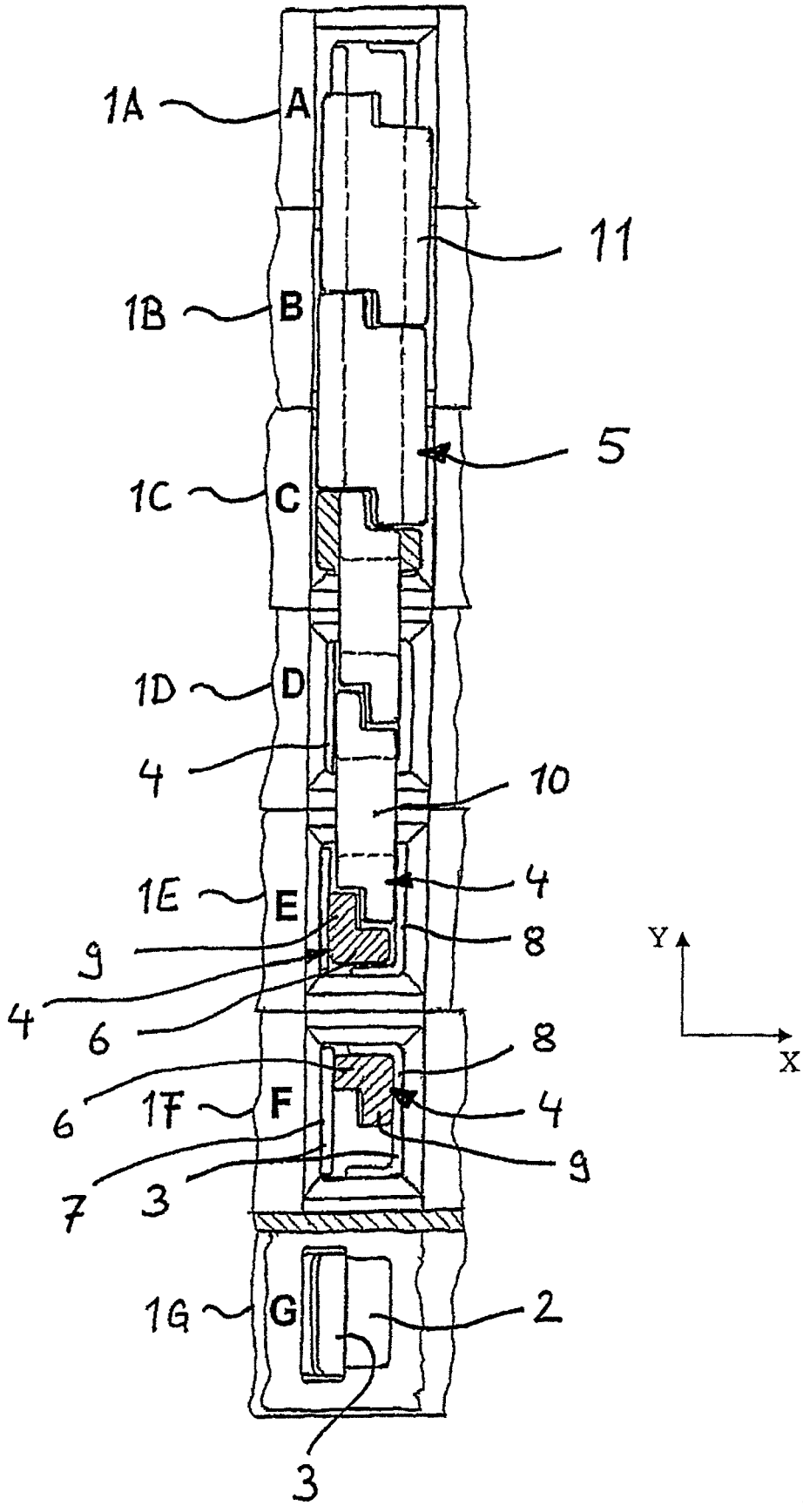

The invention relates to a bridge element having at least two bridge prongs, which are intended to be inserted into respective bridge shafts and to make electrically conductive contact with a contact point, which is arranged in the bridge shaft, of one or more clamping elements, and having a bridge section which is electrically conductively connected to the bridge prongs, with the bridge prongs and the bridge section being electrically conductive, and with the bridge prongs extending parallel to one another in a common insertion direction. The invention also relates to a set comprising a clamping element, which has a plurality of bridge shafts which are arranged next to one another, or a plurality of clamping elements which are arranged next to one another and in each case have at least one bridge shaft, and comprising two or more bridge elements.

Bridge elements of this type are used, in particular, in order to establish a transverse electrical connection between terminal blocks which are arranged adjacent on a mounting rail.

By way of example, DE 197 08 649 B4 describes a bridge element of this type in the form of a transverse bridge for electrically connecting the busbars of terminals which are lined up with a parallel orientation in relation to one another. The transverse bridges are punched out of a flat metal material in one piece and have an upper bridging rail which runs in the plane of extent of the flat material and from which two or more plugging tongues extend away in the manner of a comb. The described transverse bridge is of single-layer design, with the bridge prongs being preliminarily spread out and making contact with the busbar laterally in the direction of extent of the bridge section.

DE 94 06 612 U1 discloses a single- or multi-pole transverse connector for connection terminals. In order to reduce the space requirement, the individual bridge prongs have a contact pin and a contact spring, said contact pin and contact spring resting directly one on the other in the assembled state and, in the process, being connected to one another in a mechanically stable manner.

A bridge element with spread-out, sprung bridge prongs is shown in DE 295 14 014 U1.

DE 195 06 859 A1, DE 195 47 557 A1, DE 33 12 002 C2, DE 36 25 240 C2, DE 42 23 540 C2 and DE 44 11 306 C1 describe comparable single- or multi-layer bridge elements.

DE 43 22 535 A1 discloses electrical terminals with transverse bridges which can be plugged in and can be arranged at a distance from and next to one another and one above the other with different height arrangements. To this end, the top webs of the transverse bridges are arranged spatially offset in relation to one another in order to interconnect the transverse bridges one in the other.

In all the known embodiments of bridge elements, a single bridge prong of a single bridge element can be accommodated for each bridge shaft, since otherwise reliable contact-connection cannot be ensured.

Proceeding from the above, the object of the present invention is to improve a bridge element, and also a set comprising a clamping element and a bridge element, such that bridge elements can be interconnectd in a more flexible manner while reducing the overall size of the bridge shafts of the clamping elements.

This object is achieved with the bridge element of the type mentioned in the introduction in that at least the external bridge prongs each have a profile which is of L-shaped cross section and has an outer contact section which extends flat in the direction of extent and in the bridging direction which faces the adjacent bridge prongs, and an inner contact section which starts from the outer contact section transverse to the bridging direction, and in that the inner contact sections of the two external bridge prongs are at a smaller distance from one another than the distance between the free ends of the outer contact sections of the two external bridge prongs in relation to one another.

In order to be able to selectively accommodate one or more bridge prongs of bridge elements in a single bridge shaft and reliably make contact with a clamping element at the contact point which is arranged in the bridge shaft, the invention proposes designing the bridge prongs with an L-shaped cross section. This results in two L-shaped bridge elements resting one on the other by way of their bearing face of the L-limbs which is transverse to the spring direction, and therefore a continuous force-fitting and electrical connection being established. That limb of the L-shaped profile which runs in the spring direction ensures, in contrast, a force-fitting electrical connection to the clamping element if only one single bridge prong is present. In addition, this limb can play a part in adjusting the position of the prongs in the bridge shaft.

It is particularly advantageous when the L-shaped profiles of the two external bridge prongs are oriented in opposite directions to one another such that the outer contact sections of the two external bridge prongs are offset in relation to one another and also extend in different planes to one another.

In this case, the outer contact sections which are oriented transverse to the clamping force of the clamping elements by way of their bearing surface are arranged in different planes to one another, and therefore the outer contact sections of two bridge prongs rest one on the other and are pressed onto one another by clamping elements, in order to thus achieve reliable electrical connection.

It is also advantageous when the bridge section of a bridge element, which bridge section extends from one bridge prong to the next, is encased by insulating material. This can prevent damage to the surrounding area when voltage potential is applied to the bridge element. In addition, the ability to handle the bridge elements is improved by the casing, and adjustment of creepage distances and air gaps is improved. The casing can also be used to mark the bridge elements and their direction of extent.

In one advantageous embodiment, one bridge element has exactly two bridge prongs. In this case, a large number of bridge elements for the transverse connection of one terminal block to the other can be provided for a number of terminal blocks which are arranged next to one another on a mounting rail, it being possible for the transverse connections to be designed to be highly flexible, possibly by leaving out individual bridges between adjacent terminal blocks, with the aid of standard identical bridge elements.

Bridge prongs and the bridge section are preferably integrally produced from an electrically conductive material. They can be produced using customary forming techniques.

The invention is also achieved by a set of the type mentioned in the introduction in that the width of the outer contact sections of the bridge elements in the bridging direction and the thickness of the outer contact sections transverse to the bridging direction and the direction of extent and also the width and thickness of the outer contact sections are matched to the cross sections of the bridge shafts such that in each case two bridge prongs of two bridge elements can be inserted into a common bridge shaft such that they overlap in the respective outer contact section, and in the process jointly come into electrically conductive contact with a single clamping element which is arranged in said bridge shaft, with the guide sections of the two bridge prongs being spaced apart from one another by the interposed contact sections.

Advantageous embodiments are described in the dependent claims.

Figure 2:
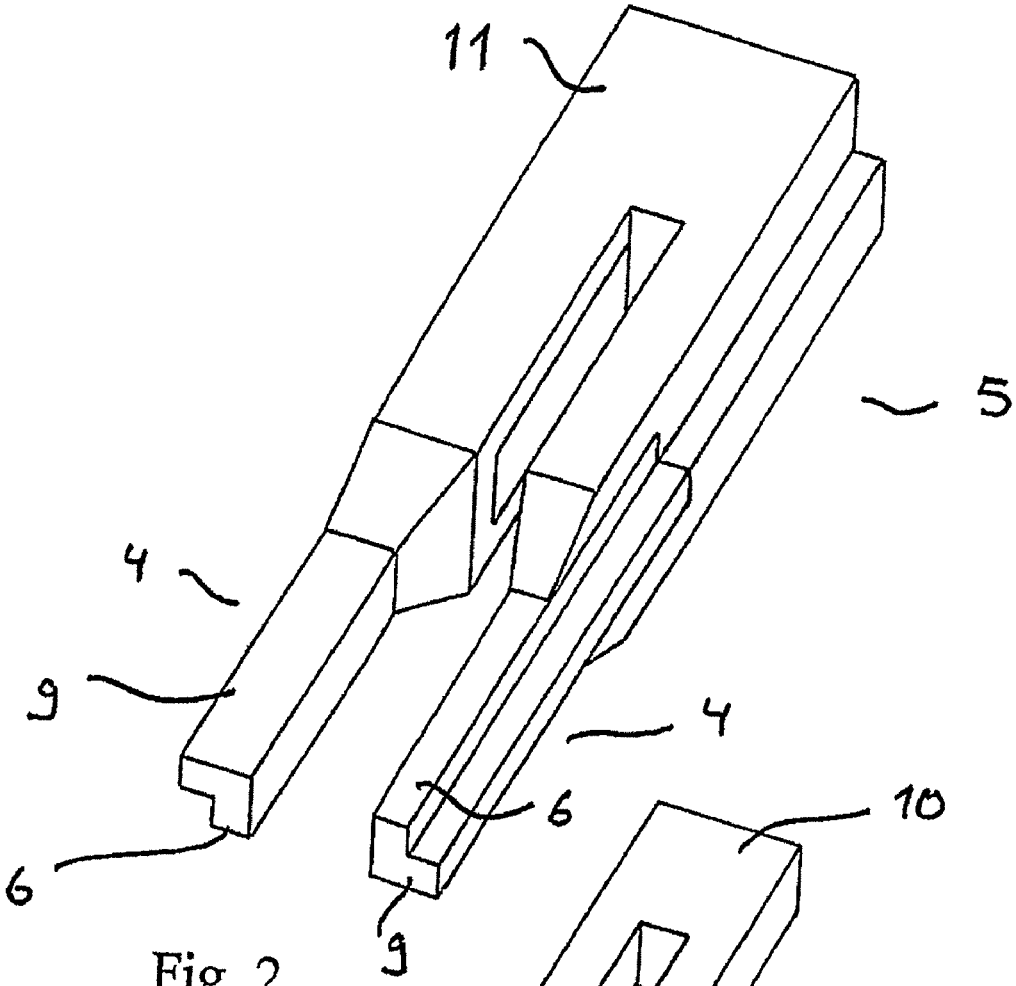
Figure 3:
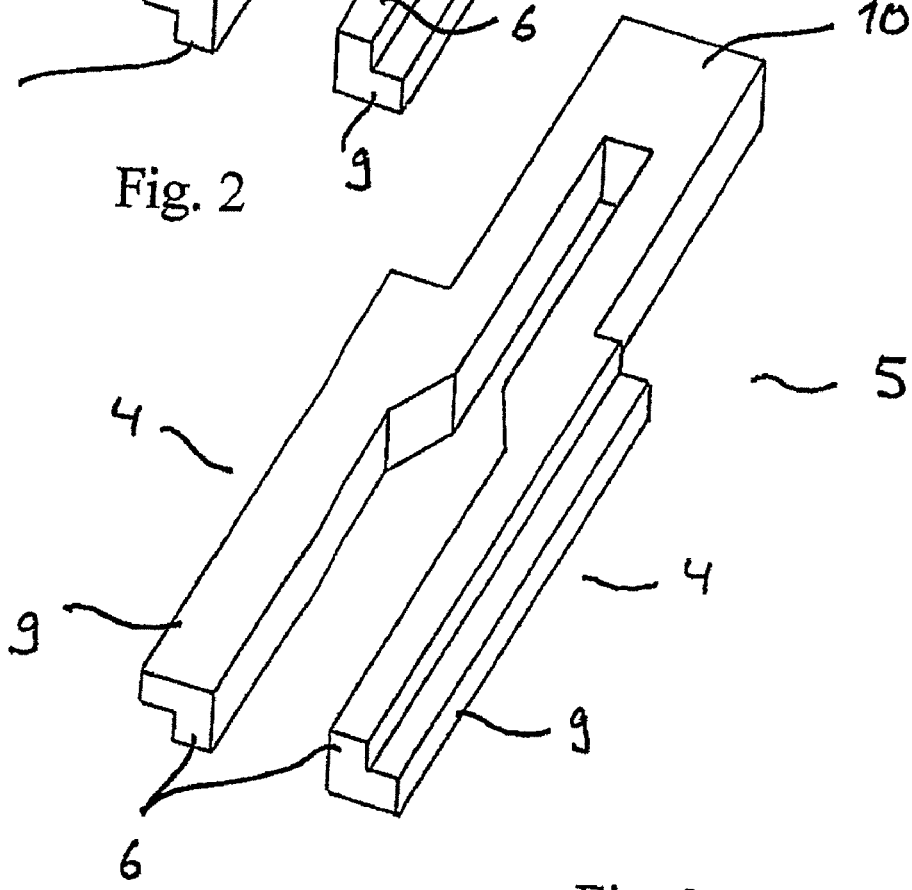
Figure 4:
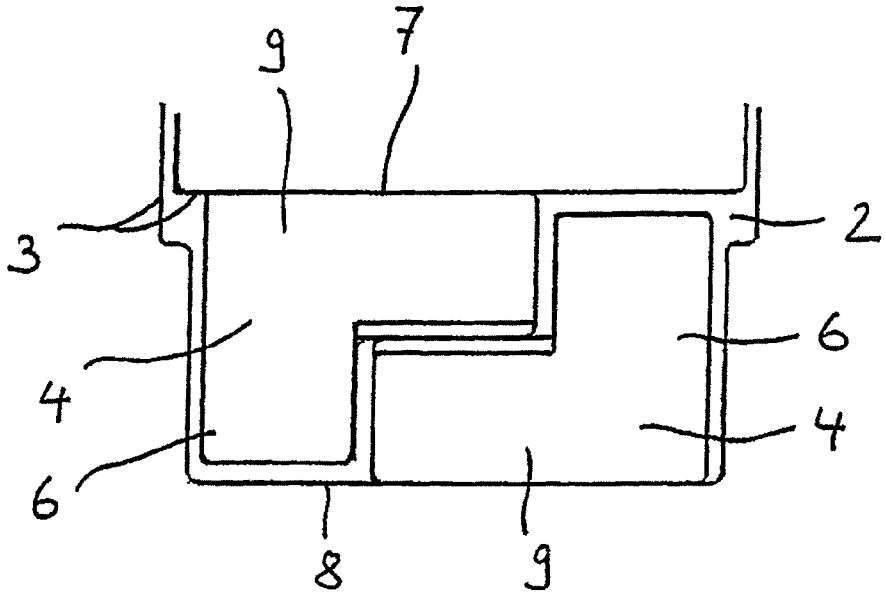
Figure 5:
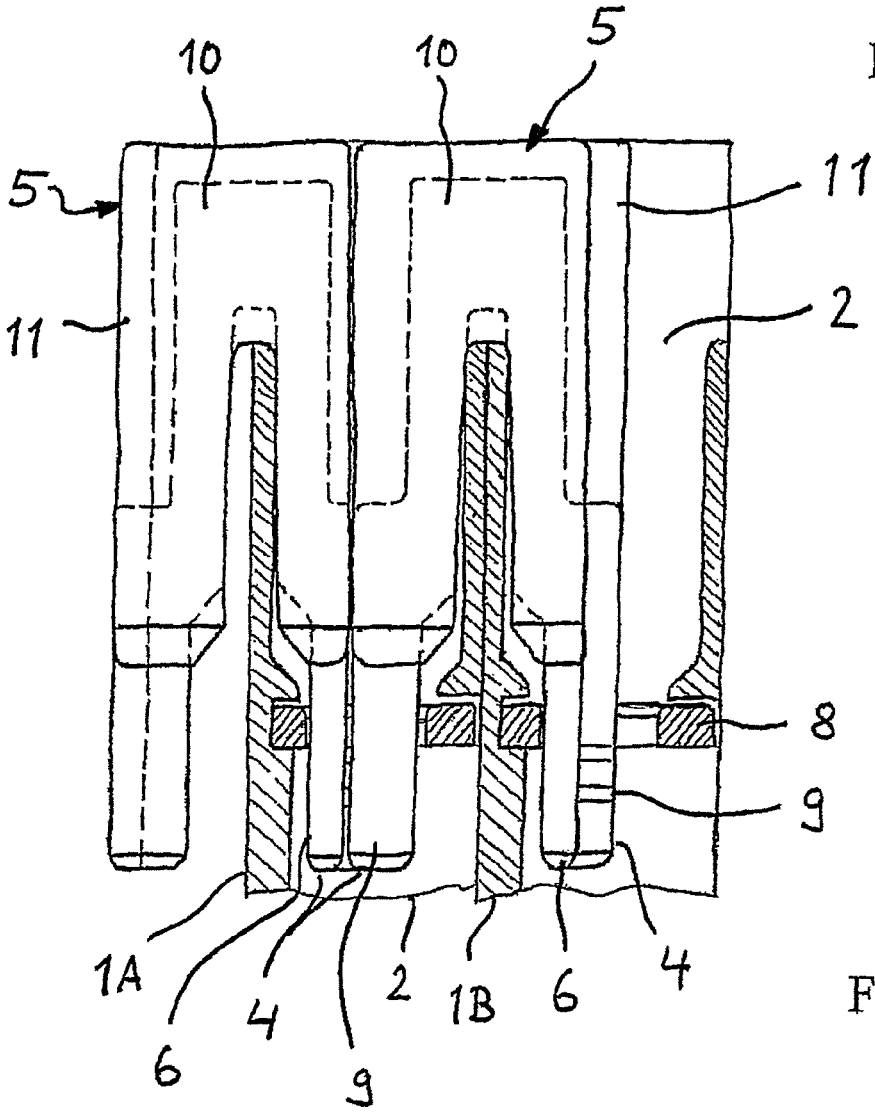
Figure 6:
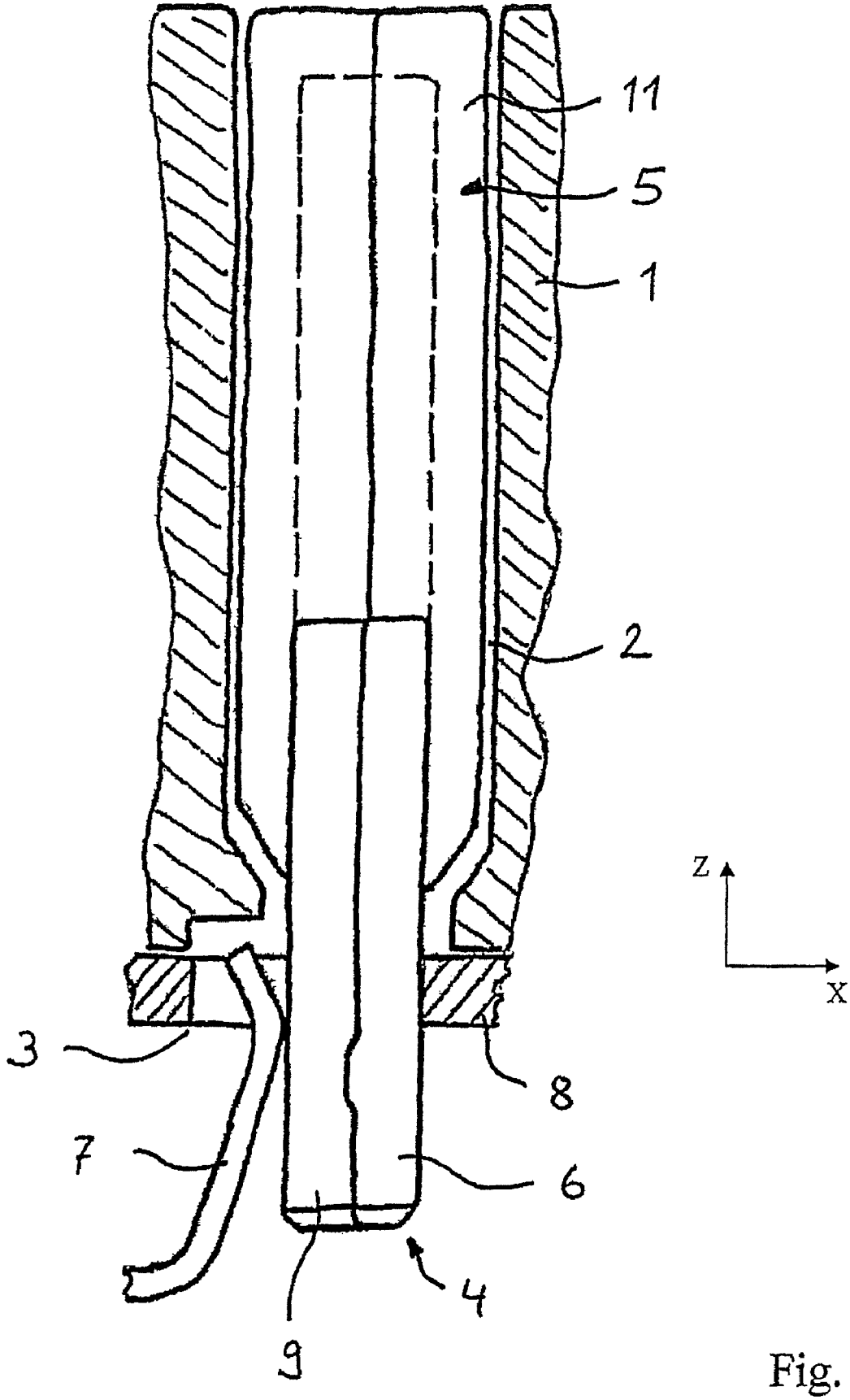

The invention is explained in greater detail below with reference to the appended drawings, in which:

FIG. 1—shows a plan view of a detail of a row of terminal blocks which are arranged next to one another on a mounting rail and have the bridge elements arranged on parts of said terminal blocks in various sectional planes;

FIG. 2—shows a perspective view of a bridge element;

FIG. 3—shows a perspective view of the bridge element from FIG. 2 without insulating material;

FIG. 4—shows sketches of two L-shaped bridge prongs which are inserted into a bridge shaft;

FIG. 5—shows a sectional side view through clamping elements which are arranged next to one another and have bridge elements inserted therein;

FIG. 6—shows a longitudinal sectional view through a clamping element with a bridging element inserted therein in the region of a bridge shaft.

FIG. 1 shows a detail of a number of clamping elements 1A-1G which can be plugged onto a mounting rail (not illustrated) in a manner which is known per se so as to adjoin one another. The clamping elements 1A-1G are single-row terminal blocks which are known per se and in each case have a bridge shaft 2 in which a contact point 3 in the form of a spring clamping element is arranged in each case. The contact point 3 is connected to a busbar in the clamping element 1A-1G and to a conductor clamping connection or the like which is connected to said clamping element in an electrically conductive manner.

The sectional view in the sectional plane through the clamping element 1F shows how a single bridge prong 4 of a bridge element 5, which bridge prong is arranged in the bridge shaft 2, is electrically contact-connected and firmly clamped at a contact point 3. It is clear that the bridge prong 4 has a profile of L-shaped cross section with an inner contact section 6 which extends in the X direction, transverse to the bridging direction Y, and which rests, at one end, against the spring element 7 of the contact point 3 and, at the other end, on the opposite side, rests on a mating bearing 8 of the contact point 3. The bridge prong 4 is therefore firmly clamped and electrically contact-connected by means of the inner contact section 6 in the contact point 3.

Transverse to the inner contact section, the L-shaped profile of the bridge prongs has an outer contact section 9, of which the entire surface of the outer face rests against the mating bearing 8.

The section through the adjacent clamping element 1E shows the state of the clamping of bridge elements 5 when two bridge prongs 4 of two bridge elements 5 are inserted into a single common bridge shaft 2. In this case, the inner faces of the outer contact sections 9 of the two bridge prongs 4 rest against one another. The spring element 7 presses against the outer face of the adjoining outer contact section 9 of a bridge prong 4, whereas the outer face of the outer contact section 9 of the other bridge prong 4 rests flat on the opposite mating bearing 8 of the contact point 3.

It can also be seen that the inner contact sections 6 of the two bridge prongs 4, which inner contact sections extend transverse to the outer contact section 9 as seen in cross section, are not clamped into the contact point 3 on both sides at their outer edges. The length of the inner contact sections 6 is therefore dimensioned such that said length is lower than the thickness of two outer contact sections which rest one on the other, and therefore a force-fit is ensured between the spring element 7 and the mating bearing 8 by means of the outer contact sections 9 of the bridge sections.

Whereas the bridge prong 4 is electrically conductively contact-connected and mechanically fixed by means of the inner contact sections 6 when only a single bridge prong 4 is inserted into a bridge shaft 2, the outer contact section 9 is used to ensure the clamping contact when two bridge prongs are inserted.

The section at the transition between the clamping elements 1E and 1D and between the clamping elements 1D and 1C shows that two bridge prongs 4 of a bridge element 5, Which bridge prongs extend parallel to one another and at a distance from one another in the same direction, are connected to one another above the bridge shafts 2 by a bridge section 10, and therefore the two bridge prongs 4 of a bridge element 5 are connected to the same voltage potential and it is possible to transmit power from one bridge prong 4 to the next.

The sectional view at the transition of the clamping elements at 1C to 1B and 1B to 1A also shows that the bridge sections 10 are encased by an insulating material 11. In this way, the respective bridge element 5 can not only be handled better, but the surrounding area is also protected against damage by electrical voltage potential, and it is possible to ensure that creepage distances and air gaps can be maintained.

FIG. 2 shows a perspective view of a bridge element 5 with the casing by the insulating material 11 in the upper region, and the bridge prongs 4 which project downward. Said figure also shows the profile, which is of L-shaped cross section, of the bridge prongs 4. It can be seen here that the L-shaped profiles of the two external bridge prongs 4 are oriented in opposite directions to one another such that the outer contact sections 9 are offset in relation to one another and extend in different planes to one another. In the illustrated exemplary embodiment, the outer contact section 9 of the left-hand bridge prong 4 is arranged in a plane above the plane of the right-hand outer contact section 9 of the right-hand bridge prong 4. When two identical bridge elements 5 are inserted next to one another, the higher outer contact section 9 of the left-hand bridge prong 4 would then rest, by way of its inner face, on the inner face of the lower outer contact section 9 of the right-hand bridge prong 4, in order to thus create a force-fit and an electrical contact-connection via the inner faces. In order to be able to arrange the bridge elements 5 next to one another and, in the process, to interconnect the bridge prongs 4 as described, the insulating material 11 has a corresponding L-shaped contour in the upper region.

FIG. 3 shows a bridge element 5 without insulating material in the upper region. It can be seen that the bridge prongs 4 are electrically conductively connected to one another in the upper region by a bridge section 10. The bridge section 10 is integrally produced with the bridge prongs 4 and additionally holds the bridge prongs 4 with a parallel orientation in relation to one another.

The contour of the bridge section 10 and of the transition to the bridge prongs 4 is matched to the spatial conditions and to the maximum current to be expected. In particular, the flow cross section should be sufficient to avoid heating or an undesired resistance.

FIG. 4 shows a side view through a bridge shaft 2 of a clamping element 1 with two bridge prongs 4 arranged in the bridge shaft 2. It can again be seen that the outer contact sections 9 of the two bridge prongs 4 rest one on the other at their inner face, and the bridge prongs 4 are contact-connected to the spring element 7 and mating bearing 8 of the contact point 3 which each rest against the outer faces of the contact sections 9. In contrast, the inner contact sections 6 have no function in this case and serve merely to guide the bridge prongs 4 in the bridge shaft 2.

FIG. 5 shows a sectional side view through two clamping elements 1A, 1B which are arranged next to one another, with two bridge prongs 4 of two adjacent bridge elements 5 being inserted into the bridge shaft 2 of the left-hand clamping element 1A. In contrast, only a single bridge prong 4 of the right-hand bridge element 5 is inserted into the bridge shaft 2 in the right-hand clamping element 1B.

However, reliable contact-connection of the bridge prongs 4 through the contact point 3 in the respective bridge shaft 2 is ensured in both cases by the bridge prongs 4 being clamped in the clamping element 1A at the contact point 3 by way of the outer contact sections 9 of said bridge prongs when contact is made with two bridge prongs 4, and the individual bridge prong 4 being clamped in the clamping element 1B by means of the inner contact section 6.

FIG. 6 shows a longitudinal sectional view through a clamping element 1, in which a bridge element 5 is inserted into a bridge shaft 2. A bridge prong 4 projects downward into a contact point 3 which is designed by a spring element 7 and a mating bearing 8 in the form of a busbar with a passage opening. The spring element 7 projects into the passage opening and rests on the outer face of the outer contact section 9 of the bridge prong 4 which extends transverse to the spring direction X as seen in cross section. In the illustrated exemplary embodiment, only a single bridge prong 4 is inserted into the bridge shaft 2, and therefore the bridge prong 4 is pressed, by way of the narrow edge of the inner contact section 6, against the inner edge of the passage opening of the mating bearing 8, said inner edge being situated opposite the spring element 7. This ensures electrical contact between the bridge element 4 and the mating bearing 8 (busbar).

The invention claimed is:

1. A bridging element (5) having at least two bridge prongs (4), which are intended to be inserted into respective bridge shafts (2) and to make electrically conductive contact with a contact point (3), which is arranged in the bridge shaft (2) , of one or more clamping elements (1A-1G), and having a bridge section (10) which is electrically conductively connected to the bridge prongs (4), with the bridge prongs (4) and the bridge section (10) being electrically conductive, and with the bridge prongs (4) extending parallel to one another in a common insertion direction (Z), wherein at least the external bridge prongs (4) each have a profile which is of L-shaped cross section and has an outer contact section (9) which extends flat in the direction (Z) of extent and in the bridging direction (Y) which faces the adjacent bridge prongs (4), and an inner contact section (6) which starts from the outer contact section (9) transverse to the bridging direction (Y), and wherein the inner contact sections (6) of the two external bridge prongs (4) are at a smaller distance from one another than the distance between the free ends of the inner contact sections (9) of the two external bridge prongs (4) in relation to one another.

2. The bridge element (5) as claimed in claim 1, wherein the L-shaped profiles of the two external bridge prongs (4) are oriented in opposite directions to one another such that the outer contact sections (9) of the two external bridge prongs (4) are offset from one another and extend in different planes to one another.

3. The bridge element (5) as claimed in claim 1, wherein the L-shaped profiles of the two external bridge prongs (4) are oriented in the same direction to one another such that the outer contact sections (9) of the two external bridge prongs (4) lie in a common plane.

4. The bridge element (5) as claimed in claim 1, wherein the bridge section (10) is encased by insulating material.

5. The bridge element (5) as claimed in claim 1, distinguished by exactly two bridge prongs (4).

6. The bridge element (5) as claimed in claim 1, wherein the bridge prongs (4) and the bridge section (10) are integrally produced from electrically conductive material.

7. A set comprising a clamping element (1), which has a plurality of bridge shafts (2) which are arranged next to one another, or a plurality of clamping elements (1A-1G) which are arranged next to one another and in each case have at least one bridge shaft (2), and comprising two or more bridge elements (5) as claimed in claim 1, wherein the width of the outer contact sections (9) in the bridging direction (Y) and the thickness of the outer contact sections (9) transverse (X) to the bridging direction (Y) and the direction (Z) of extent and also the width and thickness of the inner contact sections (6) are matched to the cross sections of the bridge shafts (2) such that in each case two bridge prongs (4) of two bridge elements (5) can be inserted into a common bridge shaft (2) such that they overlap in the respective outer contact section (9), and in the process jointly come into electrically conductive contact with a single contact point (3) which is arranged in said bridge shaft, with the inner contact sections (6) of the two bridge prongs (4) being spaced apart from one another by the interposed outer contact sections (9).

8. The set as claimed in claim 7, wherein the thickness of the inner contact sections (6) transverse to the bridging direction (Y) is smaller than the thickness of two outer contact sections (9) which lie one on the other.

9. The set as claimed in claim 7, wherein the clamping elements (1A-1G) are terminal blocks, distributor terminals or relay bases which can be latched onto a top-hat rail.

10. The set as claimed in claim 9, wherein the terminal blocks have conductor connections which are electrically conductively connected to the contact points (3) in the bridge shafts (2).

11. The set as claimed in claim 9, wherein the terminal blocks have an integrated or plug-on electronics system.

* * * * *

UNITED STATES PATENT AND TRADEMARK OFFICE

CERTIFICATE OF CORRECTION

PATENT NO. : 8,075,336 B2
APPLICATION NO. : 12/822448
DATED : December 13, 2011
INVENTOR(S) : Hans-Josef Koellmann It is certified that error appears in the above-identified patent and that said Letters Patent is hereby corrected as shown below:

Title page, Item 75, Inventor should read --Hans-Josef Koellmann, Minden (DE)--

Signed and Sealed this
Seventh Day of February, 2012

David J. Kappos

David J. Kappos
*Director of the United States Patent and Trademark Office*